US005555942A

United States Patent [19]

Matsushita et al.

[11] Patent Number: 5,555,942

[45] Date of Patent: Sep. 17, 1996

[54] BLADE CONTROL SYSTEM FOR USE IN A BULLDOZER

[75] Inventors: Shigenori Matsushita; Shigeru Yamamoto; Shu H. Zhang; Satoru Nishita; Kazushi Nakata, all of Hirakata, Japan

[73] Assignee: Kabushiki Kaisha Komatsu Seisakusho, Tokyo, Japan

[21] Appl. No.: 260,394

[22] Filed: Jun. 15, 1994

[30] Foreign Application Priority Data

Jun. 16, 1993 [JP] Japan ..... 5-145058

[51] Int. Cl.[6] ..... A01B 67/00

[52] U.S. Cl. ..... 172/3; 172/4.5; 364/424.07

[58] Field of Search ..... 172/2, 3, 4, 4.5, 172/7, 9, 821; 364/424.07; 414/699; 37/348, 907, 382

[56] References Cited

U.S. PATENT DOCUMENTS

| | | | |
|---|---|---|---|
| 4,157,118 | 6/1979 | Suganami et al. | 172/7 X |
| 4,211,282 | 7/1980 | Frisbee | 172/7 |
| 4,282,933 | 8/1981 | Suganami et al. | 172/4.5 |
| 4,423,785 | 1/1984 | Kurihara et al. | 172/3 |
| 4,518,044 | 5/1985 | Wiegardt et al. | 172/3 X |
| 4,630,685 | 12/1986 | Huck, Jr. et al. . | |
| 4,699,239 | 10/1987 | Ishino et al. | 364/424.07 X |
| 4,825,956 | 5/1989 | Kanato et al. | 172/2 |
| 4,934,463 | 6/1990 | Ishida et al. | 172/821 X |
| 5,359,517 | 10/1994 | Moriya et al. | 172/4.5 X |
| 5,361,208 | 11/1994 | Olson et al. | 364/424.07 X |
| 5,398,766 | 3/1995 | Nakayama et al. | 172/4.5 |

FOREIGN PATENT DOCUMENTS

| | | | |
|---|---|---|---|
| 53-6967 | 2/1978 | Japan . | |
| 53-5441 | 2/1978 | Japan . | |
| 55-36776 | 9/1980 | Japan . | |
| 63-31618 | 6/1988 | Japan . | |
| 1-62525 | 3/1989 | Japan . | |
| 3-43523 | 2/1991 | Japan . | |
| 9218706 | 10/1992 | Japan | 364/424.07 |
| 6-3886 | 2/1994 | Japan . | |

*Primary Examiner*—Terry Lee Melius
*Assistant Examiner*—Victor Batson
*Attorney, Agent, or Firm*—Armstrong, Westerman, Hattori, McLeland & Naughton

[57] ABSTRACT

A blade control system for use in a bulldozer comprising: a driving mode setting device which can set an automatic blade control mode during dozing operation; a running condition detector for detecting whether a transmission is placed in forward range or reverse range; and a blade controller for controlling tilting and lowering of a blade such that when the speed range detector has detected that the transmission is placed in forward range and the driving mode setting device has set the automatic blade control mode to start digging, the lower end of the blade becomes horizontal in relation to a vehicle body and is brought into contact with the ground.

19 Claims, 10 Drawing Sheets

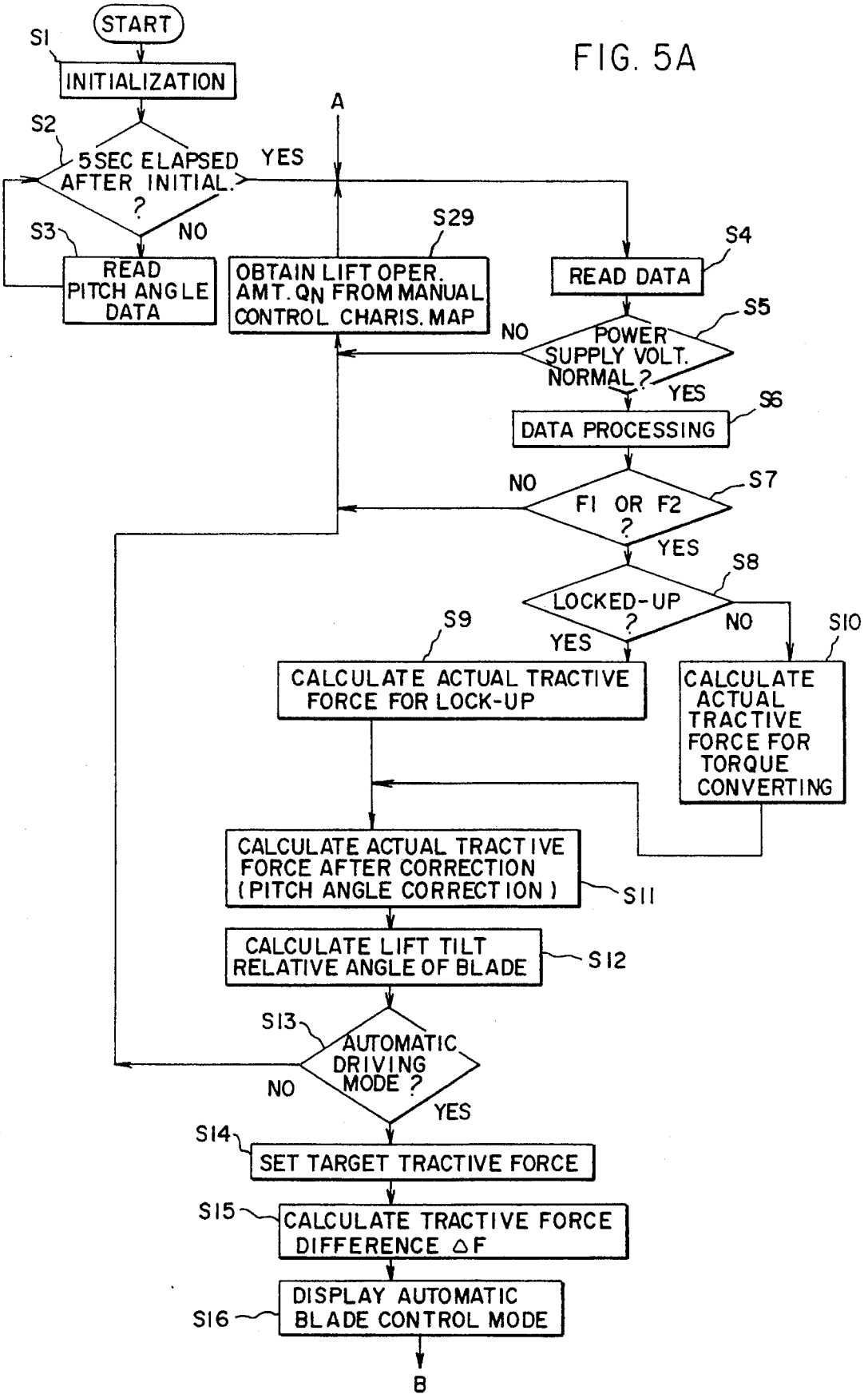
FIG. 5A
START
S1
INITIALIZATION
S2
5 SEC ELAPSED AFTER INITIAL. ?
YES
NO
S3
READ PITCH ANGLE DATA
A
S29
OBTAIN LIFT OPER. AMT. QN FROM MANUAL CONTROL CHARIS. MAP
S4
READ DATA
S5
POWER SUPPLY VOLT. NORMAL ?
NO
YES
S6
DATA PROCESSING
S7
F1 OR F2 ?
NO
YES
S8
LOCKED-UP ?
NO
YES
S9
CALCULATE ACTUAL TRACTIVE FORCE FOR LOCK-UP
S10
CALCULATE ACTUAL TRACTIVE FORCE FOR TORQUE CONVERTING
CALCULATE ACTUAL TRACTIVE FORCE AFTER CORRECTION (PITCH ANGLE CORRECTION)
S11
CALCULATE LIFT TILT RELATIVE ANGLE OF BLADE
S12
S13
AUTOMATIC DRIVING MODE ?
NO
YES
S14
SET TARGET TRACTIVE FORCE
S15
CALCULATE TRACTIVE FORCE DIFFERENCE ΔF
S16
DISPLAY AUTOMATIC BLADE CONTROL MODE
B

BLADE CONTROL SYSTEM FOR USE IN A BULLDOZER

BACKGROUND OF THE INVENTION (1) Field of the Invention

The present invention relates to a system for controlling a blade in a bulldozer when digging is started or when the bulldozer moves backwards during dozing operation.

(2) Description of the Prior Art

Dozing operation with a bulldozer was previously performed by manual operation by the operator who drives the bulldozer and, more concretely, it was performed by manually operating a shift lever to change speed ranges, a steering lever to change directions, and a blade control lever to lift, lower or laterally tilt the blade.

SUMMARY OF THE INVENTION

In such manually performed dozing operation, when the operator starts digging by shifting the shift lever to forward gear, it is necessary to lower the blade to the ground line and to perform so-called tilt operation to make the lower end of the blade horizontal in relation to the vehicle body if the blade is inclined laterally. When the desired dozing operation is finished and the operator drives the bulldozer backwards to a digging point by shifting the shift lever to reverse gear, it is necessary to lower the blade to its running position (i.e., the lowest position above the ground) after lifting it once to a specified position.

The above described operations required at the start of digging or at the time of backward moving are carried out many times in the course of dozing, and therefore, even if the operator is very skillful, he is fatigued from repeatedly performed lifting, lowering and tilting. The operator often exhausts his nerves especially when performing the tilt operation to make the blade horizontal, since he has to concentrate his attention on the operation without a target. Further, there is a good possibility for an accident if the operator lifts the blade higher than a specified height by mistake when the bulldozer moves backwards, because the vehicle body easily loses its balance when it moves with the blade at a high position.

The present invention has been made in order to overcome the above problems and therefore one of the objects of the invention is to provide a blade control system for use in a bulldozer by which operations repeatedly performed by the operator at the start of digging or at the time of backward moving can be eliminated, thereby reducing the operator's fatigue and enhancing the safety of the dozing operation.

In order to accomplish the above objective, a blade control system for use in a bulldozer according to one aspect of the invention comprises:

(a) driving mode setting means which can set an automatic blade control mode during dozing operation;

(b) running condition detector means for detecting whether a transmission is placed in forward range or reverse range; and (c) blade controller means for controlling tilting and lowering of a blade such that when the running condition detector means has detected that the transmission is placed in forward range and the driving mode setting means has set the automatic blade control mode to start digging, the lower end of the blade becomes horizontal in relation to a vehicle body and is brought into contact with the ground.

In the above-described blade control system for use in a bulldozer, if it is detected that the transmission is placed in forward range and digging is started with the automatic blade control mode set by the driving mode setting means, the blade controller means tilts the blade such that the lower end of the blade becomes horizontal in relation to the vehicle body and lowers the blade such that the lower end of the blade comes in contact with the ground.

With this arrangement, the operator can smoothly move the blade to a predetermined reference position for the start of digging without getting exhausted, so that efficient dozing operation can be achieved.

Preferably, there is provided in the invention blade lifting/lowering means having a pair of hydraulic cylinders one of which is disposed, for example, between the right end of the blade and the vehicle body and the other of which is disposed between the left end of the blade and the vehicle body. It is also preferable to provide the invention with blade position detector means for detecting the lifted/lowered position and tilted position of the blade. The blade position detector means may detect the lifted/lowered position and tilted position of the blade by detecting the strokes of a pair of hydraulic cylinders provided in the blade lifting/lowering means.

Further, there is preferably provided blade tilting means for tilting the blade in relation to the vehicle body by lifting or lowering the right or left end of the blade. The blade tilting means may comprise one hydraulic cylinder disposed between one end of the blade and the vehicle body and one brace disposed between the other end of the blade and the vehicle body.

The blade controller means may be designed to control the blade such that the blade is lowered after being tilted or that the blade is tilted after being lowered.

According to another aspect of the invention, there is provided a blade control system for use in a bulldozer comprising:

(a) driving mode setting means which can set an automatic blade control mode during dozing operation;

(b) running condition detector means for detecting whether a transmission is placed in forward range or reverse range; and (c) blade controller means for controlling tilting and lowering of a blade such that when the running condition detector means has detected that the transmission is placed in reverse range and the driving mode setting means has set the automatic blade control mode, the lower end of the blade takes its backward moving position which is at a specified distance above the ground.

In the above-described blade control system for use in a bulldozer, if it is detected that the transmission is placed in reverse range and the automatic blade control mode is set by the driving mode setting means, the blade is lowered when the blade is positioned higher than its backward moving position and is lifted when it is positioned lower than the backward moving position, so that the blade takes the backward moving position where the lower end of the blade is at a specified distance above the ground line.

With this arrangement, the operator can smoothly move the blade to a specified reference position for backward moving without getting exhausted, so that efficient dozing operation can be achieved. Further, it prevents the occurrence of accidents such as tumbling caused by running of the bulldozer with the blade being lifted above a specified height.

Preferably, there is provided in the invention blade lifting/lowering means having a pair of hydraulic cylinders one of which is disposed, for example, between the right end of the blade and the vehicle body and the other of which is between the left end of the blade and the vehicle body. It is also preferable to provide the invention with blade position detector means for detecting the lifted/lowered position of the blade. The blade position detector means may detect the lifted/lowered position of the blade by detecting the strokes of a pair of hydraulic cylinders provided in the blade lifting/lowering means.

Further, there is preferably provided driving mode switching means for switching from the automatic blade control mode to a manual operation mode after the blade has been lifted or lowered to the aforesaid backward moving position by the blade controller means.

As the automatic blade control mode, there may be provided at least an automatic digging mode associated with digging in dozing operation and an automatic carrying mode associated with carrying in dozing operation.

The driving mode setting means may be a push button selector switch, a grip-type selector switch, a twisting-type selector switch or a rotary selector switch.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIGS. 1 to 11 illustrate a preferred embodiment of a blade control system for use in a bulldozer according to the invention, wherein;

FIG. 1 is an external appearance of the bulldozer;

FIG. 2 is a skeleton diagram of a power transmission system;

FIG. 3 is a schematic block diagram of the overall construction of the blade control system;

FIG. 4 is a detail view of a blade lift cylinder stroke sensor;

FIGS. 5A and 5B are a flowchart of a dozing program;

FIGS. 6 to 10 are a graph showing a curved engine characteristic map; graph showing a pump correction characteristic map; graph showing a curved torque converter characteristic map; graph showing a pitch angle-load correction value characteristic map; and graph showing a load control characteristic map, respectively; and FIG. 11 is a part of a flowchart of a modification of the dozing program.

PREFERRED EMBODIMENTS OF THE INVENTION

With reference to the drawings, a blade control system for use in a bulldozer according to a preferred embodiment of the invention will be hereinafter described.

Figure 1:
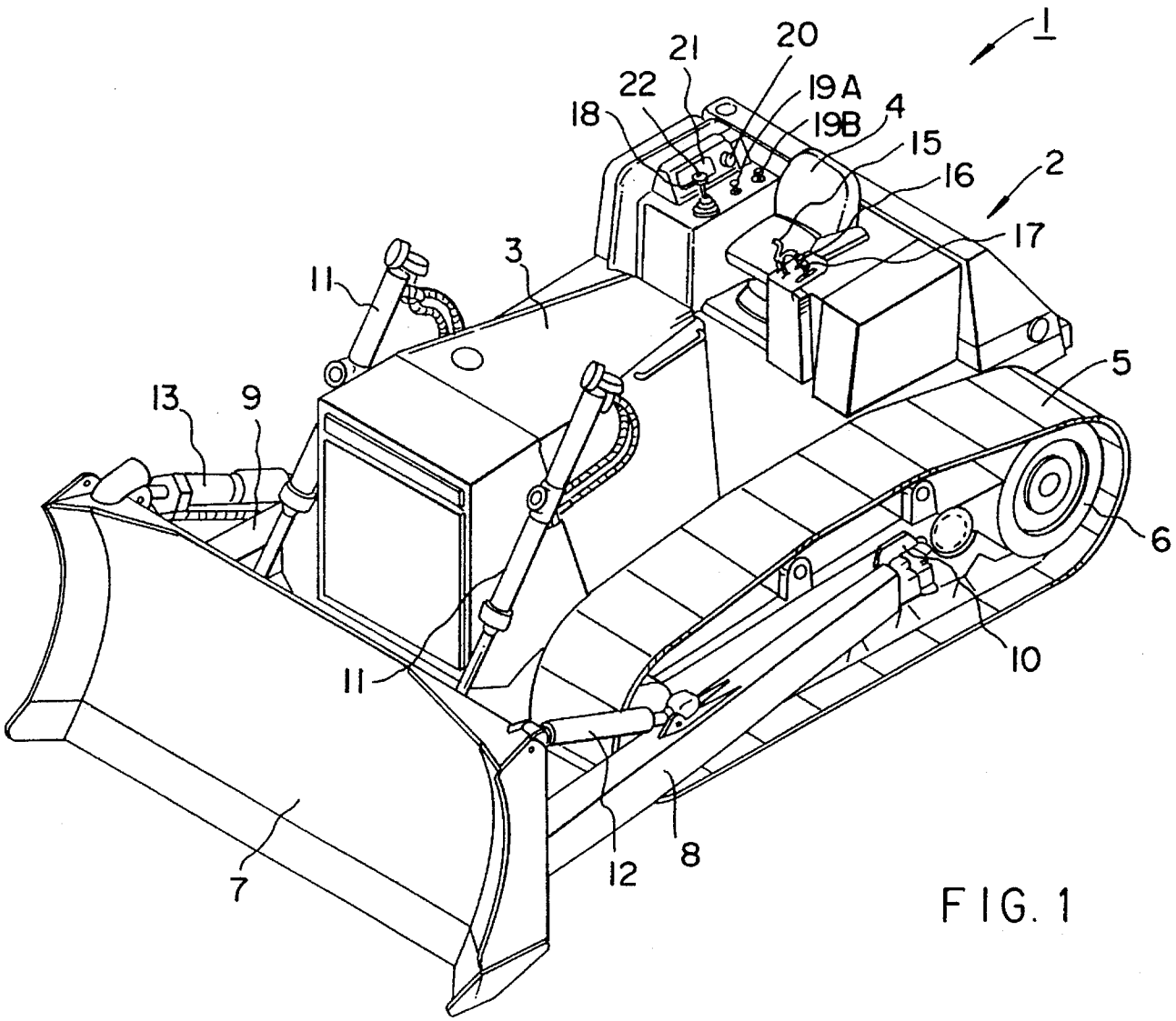

Referring to FIG. 1, there is shown the external appearance of a bulldozer 1 which is provided with, on a vehicle body 2 thereof, a bonnet 3 for housing an engine (not shown) and an operator seat 4 for the operator who drives the bulldozer 1. Both sides (i.e., the right and left sides of the vehicle body 2 when viewed in its moving direction) of the vehicle body 2 are provided with crawler belts 5 (the crawler belt on the right side is not shown) for running the vehicle body 2 so as to turn or move back and forth. Each of these crawler belts 5 are independently driven by their respective sprockets 6 actuated by driving force transmitted from the engine as shown in FIG. 2.

There are provided straight frames 8, 9 for supporting a blade 7 at the forward ends thereof. The base ends of these right and left straight frames 8, 9 are pivotally supported at the right and left sides of the vehicle body 2 by means of trunnions 10 (the trunnion on the right side is not shown) in such a manner that the blade 7 can be lifted or lowered. Disposed between the blade 7 and the vehicle body 2 are right and left blade lift cylinders 11 forming a pair for lifting or lowering the blade 7. For functioning to incline the blade 7 to the right and left, a brace 12 is disposed between the blade 7 and the left straight frame 8 and a blade tilt cylinder 13 is disposed between the blade 7 and the right straight frame 9.

There are provided a steering lever 15, a transmission shift lever 16 and a fuel control lever 17 on the left of the operator seat 4 when the vehicle body 2 is viewed in its moving direction. On the right of the operator seat 4, there are provided a blade control lever 18 for lifting, lowering the blade 7 and inclining it to the right and left; a first dial switch 19A for setting a load to be applied to the blade 7 and a second dial switch 19B for correcting the set load by adding or subtracting a correction value; and a lock-up selector switch 20 for bringing a torque convertor into a locked-up state or releasing the torque convertor from the locked-up state; and a display unit 21. The top of the blade control lever 18 is provided with a driving mode selector button 22 for switching driving modes in dozing operation and so on. According to how many times the driving mode selector button 22 is depressed, the driving mode sequentially switches between a manual operation mode, an automatic digging mode and an automatic carrying mode in dozing operation. Although they are not shown in the drawing, a brake pedal and a decelerator pedal are disposed in front of the operator seat 4 behind bonnet 3.

Figure 2:
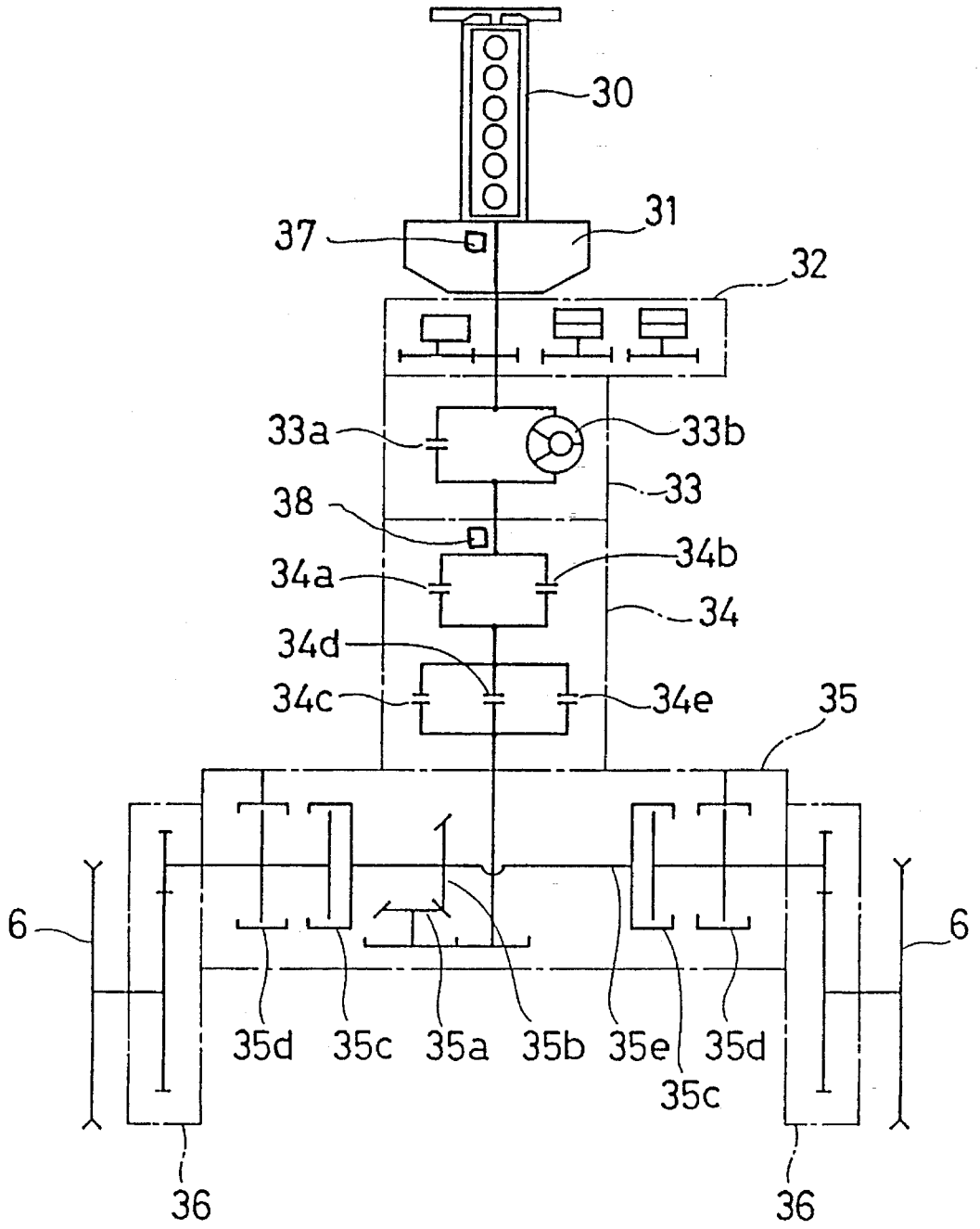

Referring to FIG. 2 which shows a power transmission system, rotary driving force from an engine 30 is transmitted to a torque convertor with a lock-up mechanism 33 through a damper 31 and a PTO 32. The torque convertor, with a lock-up mechanism 33, includes a lock-up mechanism 33*a* and a pump 33*b*, and the PTO 32 functions to drive various hydraulic pumps including hydraulic pumps for operational machines. The rotary driving force is then transmitted from an output shaft of the torque convertor with a lock-up mechanism 33 to a transmission 34 such as, for example, a planetary gear lubricated multiple-disc clutch transmission, an input shaft of which is connected to the above output shaft. The transmission 34 includes forward and reverse clutches 34*a*, 34*b* and first to third clutches 34*c* to 34*e* so that the revolution of the output shaft of the transmission 34 can be shifted in three ranges in both forward and backward directions. The rotary driving force, from the output shaft of the transmission 34, is transmitted to a steering mechanism 35 that includes a pinion 35 and a transverse shaft 35*e* on which are disposed a bevel gear 35*b*, right and left steering clutches 35*c* forming a pair, and right and left steering brakes 35*d* forming a pair. Thereafter, the rotary driving force is transmitted to a pair of final reduction mechanisms 36, disposed on the right and left hands, so that each of the sprockets 6 for running the crawler belts 5 is driven. Reference numeral 37 denotes an engine revolution sensor for detecting the revolution speed of the engine 30 and reference numeral 38 denotes a torque convertor output shaft revolution sensor for detecting the revolution speed of the output shaft of the torque convertor with a lock-up mechanism Referring to FIG. 3 which schematically shows the overall construction of the blade control system for use in a bulldozer according to the invention, the following data items are supplied to a microcomputer 40 through a bus 39: (i) dial value data sent from the first dial switch 19A, regarding the magnitude of a load applied to the blade 7, which load is set by the first dial switch 19A; (ii) dial value data sent from the second dial switch 19B, regarding a correction value to be added to or subtracted from the set load; (iii) data on the pressing operation condition of the driving mode selector button 22 for switching between the manual operation mode, automatic digging mode and automatic carrying mode, and so on, in dozing operation; (iv) revolution speed data from the engine revolution sensor 37, regarding the revolution speed of the engine 30; and (v) revolution speed data from the torque convertor output shaft revolution sensor 38, regarding the revolution speed of the output shaft of the torque convertor 33. The following data, and so on, are also supplied to the microcomputer 40 through the bus 39: (i) stroke positional data from blade lift cylinder stroke sensors 41 that detect the strokes of the right and left blade lift cylinders 11 for lifting or lowering the blade 7, respectively; (ii) pitch angle data sent from a pitch angle sensor 42 that detects the momentarily varying pitch angle of the vehicle body 2 inclining in forward and backward directions; (iii) data from a transmission speed range sensor 43 that detects the speed range selecting condition of the transmission 34, regarding a speed range selected by operating the transmission shift lever 16; (iv) data from a blade operation sensor 44 that detects whether or not the blade 7 is manually operated by the blade control lever 18; and (v) data from a torque convertor LU/TC sensor 45 that detects the locked-up (LU)/torque converting (TC) changing condition of the torque converter 33, the torque convertor 33 being switched between a lock-up on state and lock-up off state with the lock-up selector switch 20.

The microcomputer 40 is composed of a central processing unit (CPU) 40A for executing a specified program; a read only memory (ROM) 40B for storing the above program and various maps such as a curved engine characteristic map and curved torque convertor characteristic map; a random access memory (RAM) 40C serving as a working memory necessary for executing the program and as registers for various data; and a timer 40D for measuring elapsed time for an event in the program. The program is executed in accordance with (i) the dial value data on the set load to be applied to the blade 7; (ii) the dial value data on the correction value to be added to or subtracted from the set load; (iii) the data on the pressing operation condition of the driving mode selector button 22; (iv) the data on the revolution speed of the engine 30; (v) the data on the revolution speed of the output shaft of the torque convertor 33; (vi) the stroke positional data on the strokes of the right and left blade lift cylinders 11; (vii) the data on the pitch angle of the vehicle body 2 in forward and backward directions; (viii) the data on the speed range selecting condition of the transmission 34; (ix) data on whether or not the blade 7 is in manual operation; and (x) data on the locked-up (LU)/torque converting (TC) changing condition of the torque converter 33. Then, data on the lift operation amount for lifting or lowering the blade 7 is supplied to a blade lift cylinder controller 46, and the right and left blade lift cylinders 11 are actuated based on the lift operation amount by means of the controller 46 with the help of a lift valve actuator 47 and a lift cylinder operation valve 48, whereby the blade 7 is lifted or lowered. The execution of the program by the microcomputer 40 allows a blade tilt cylinder controller 49 to be provided with a tilt operation amount used for tilting the blade 7 laterally, so that the blade tilt cylinder 13 is actuated with the help of a tilt valve actuator 50 and a tilt cylinder operation valve 51, thereby tilting the blade 7. The display unit 21, FIG. 1, displays information such as whether the bulldozer 1 is presently in the manual operation mode, automatic digging mode, automatic carrying mode or other mode in dozing operation.

Figure 3:
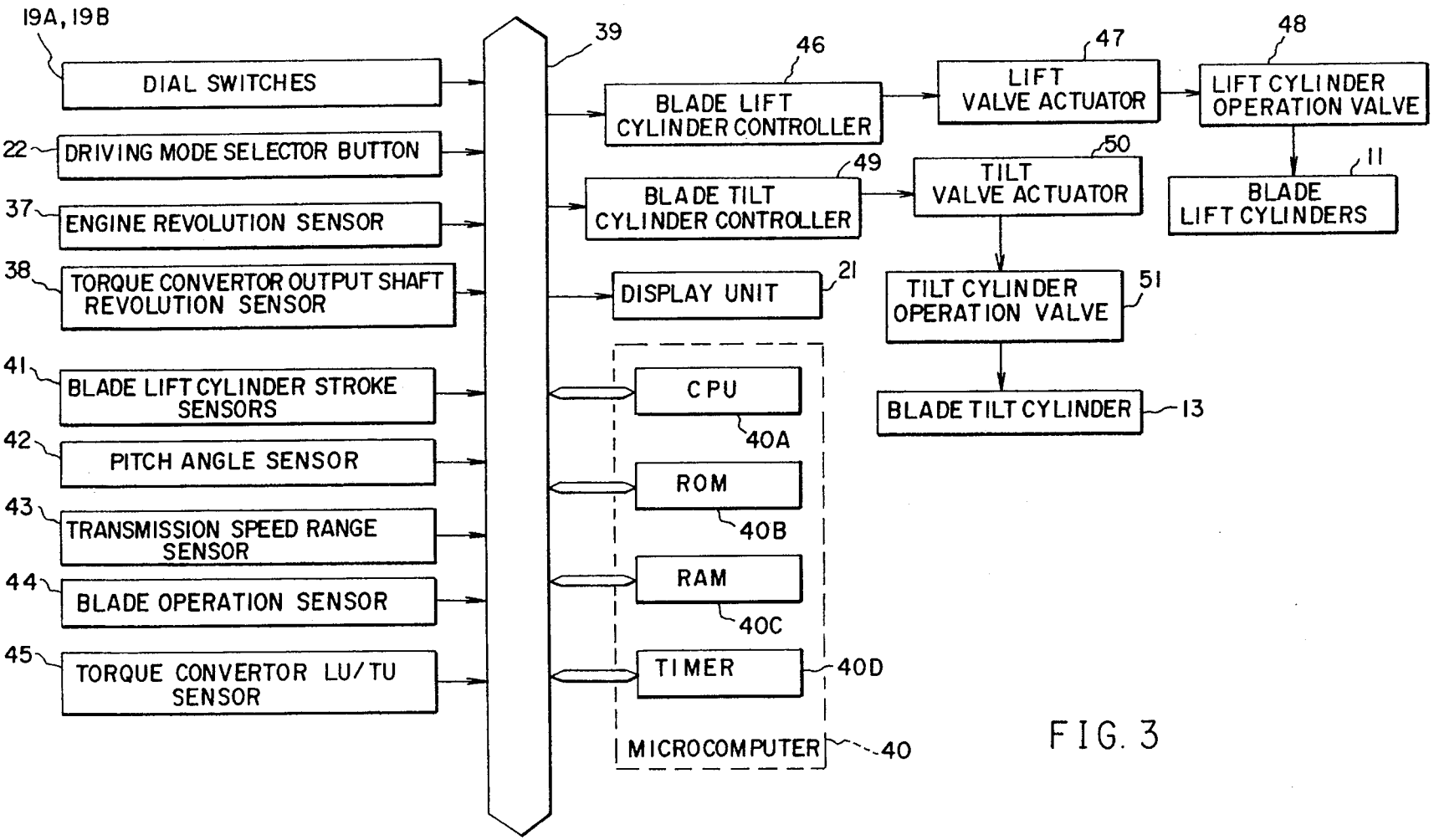
Figure 4:
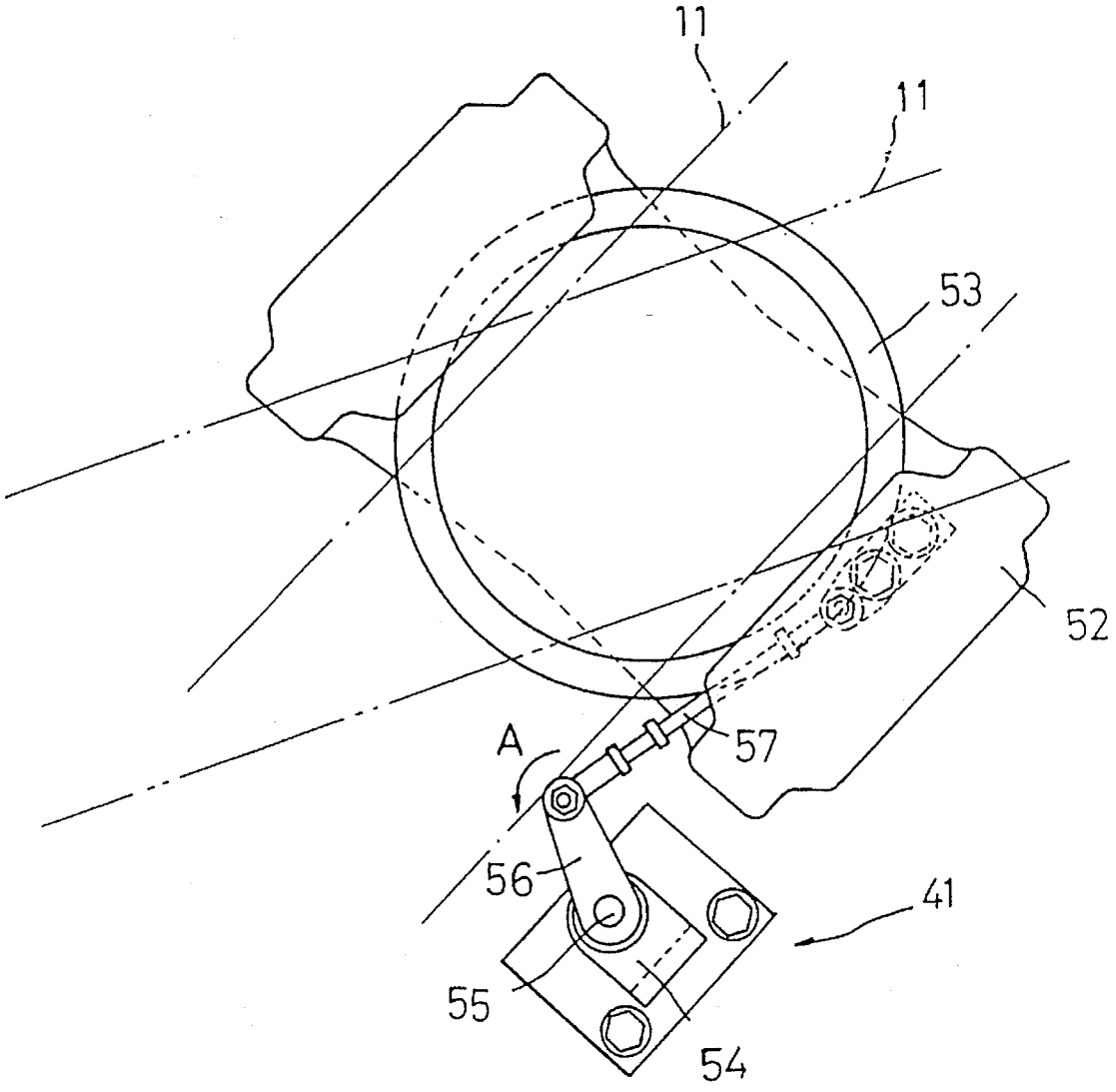

The blade lift cylinder stroke sensors 41, FIG. 3, detect, as shown in FIG. 4, the strokes of the blade lift cylinders 11 respectively, by detecting the inclinations of the blade lift cylinders 11 (FIG. 4 shows, in an enlarged form, the left side of the bulldozer 1). The right and left blade lift cylinders 11 are respectively supported on disk-like cylinder supports 53. The cylinder supports 53 are respectively rotatably supported in a vertical plane in relation to brackets 52 secured to the vehicle body 2 of the bulldozer 1. Potentiometers 54, are attached to the vehicle body 2 at the positions where the cylinder supports 53 are adjacent to the vehicle body 2. The potentiometer 54 constitutes a part of the blade lift cylinder stroke sensor 41. The forward end of an arm 56, attached to a pivotal shaft 55 of the potentiometer 54, is coupled to a rotating part of the cylinder support 53 by means of a rod 57. When the blade lift cylinder 11 is actuated to pivot from the position indicated by a chain line to the position indicated by a two-dot chain line in FIG. 4, the arm 56 pivots in the direction of arrow A being pushed by the rod 57, and the pivotal angle of the arm 56 is detected by the potentiometer 54. Because the blade lift cylinder stroke sensor 41 is provided for each of the right and left blade lift cylinders 11, the tilting amount of the blade 7 tilted by the blade tilt cylinder 13 can be detected by obtaining the difference between the strokes of the blade lift cylinders 11, the strokes being detected by the right and left blade lift cylinder stroke sensors 41.

Figure 5B:
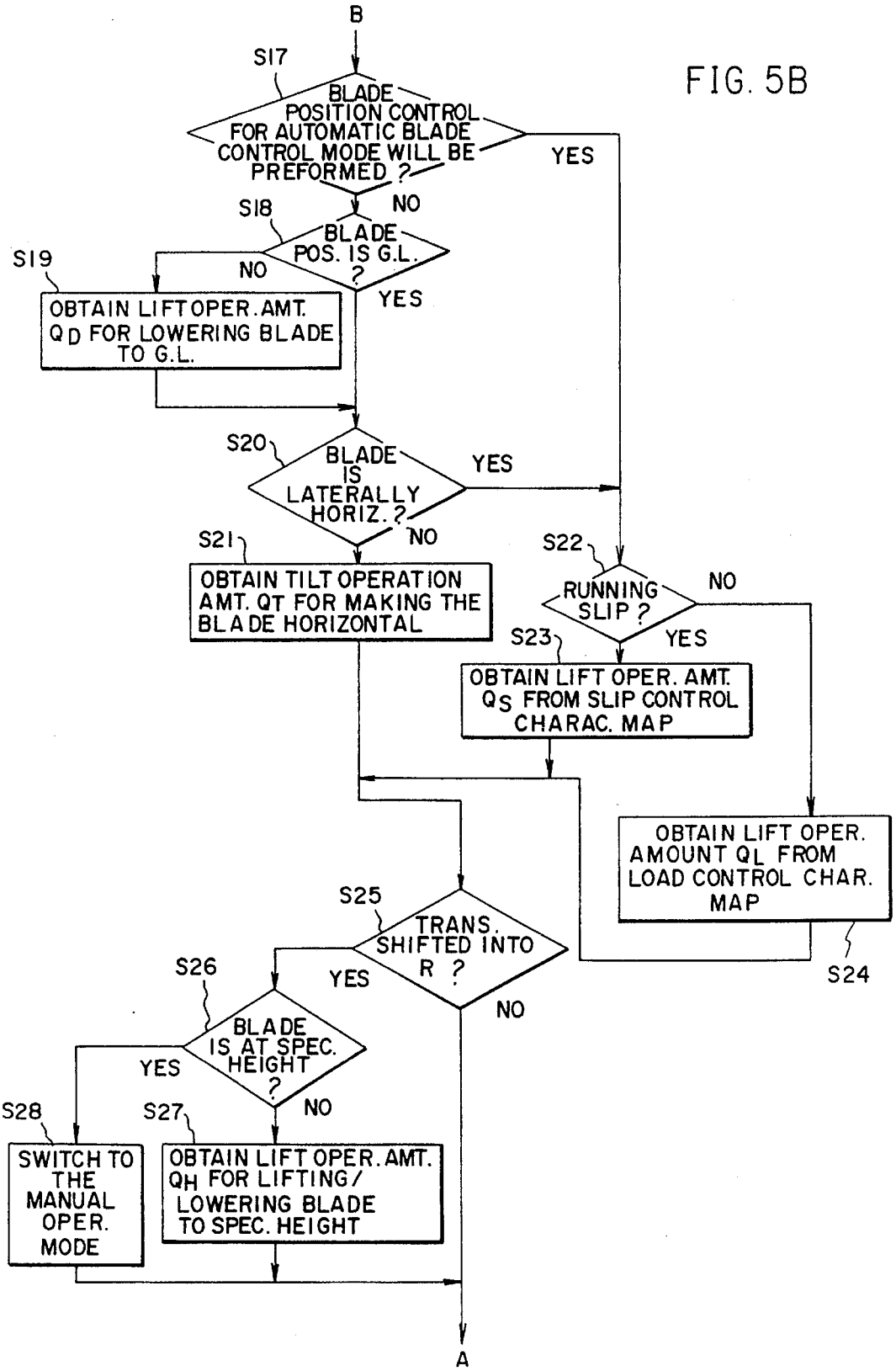

Now reference is made to the flowchart of FIGS. 5A and 5B for describing, in detail, the performance of the above-described blade control unit for use in a bulldozer.

Step 1 to Step 3, FIG. 5A: Power is loaded to start execution of the specified program and to execute initialization by clearing all the data of the registers and so on in the RAM 40C of the microcomputer 40. For a specified time (5 seconds in this embodiment) after the initialization, pitch angle data are sequentially read from the pitch angle sensor 42 as initial values. The reason why pitch angle data are sequentially read as initial values is that the pitch angle of the vehicle body 2 is obtained from the moving average of the pitch angle data by frequency separation.

Step 4 to Step 6: The following data are firstly read: (i) the dial value data sent from the first dial switch 19A, regarding a set load to be applied to the blade 7; (ii) the dial value data sent from the second dial switch 19B, regarding a correction value to be added to or subtracted from the set load; (iii) the data from the driving mode selector button 22, regarding the pressing operation condition; (iv) the data from the engine revolution sensor 37, regarding the revolution speed of the engine 30; (v) the data from the torque convertor output shaft revolution sensor 38, regarding the revolution speed of the output shaft of the torque convertor 33; (vi) the stroke positional data from the blade lift cylinder stroke sensors 41, regarding the strokes of the blade lift cylinders 11; (vii) the data from the pitch angle sensor 42, regarding the pitch angle of the vehicle body 2 in forward and backward directions; (viii) the data from the transmission speed range sensor 43, regarding the speed range selecting condition of the transmission 34; (ix) the data from the blade operation sensor 44, regarding whether or not the blade 7 is in manual operation; and (x) the data from the torque LU/TC sensor 45, regarding the locked-up (LU)/torque converting (TC) condition of the torque converter 33. Then, if the voltage of the power source is normal, i.e., 55, more than a specified value and the electronic circuit and other devices are in a normal driving condition, the following data processing, 56, is executed.

1. Low frequency components are derived from the sequentially read pitch angle data by frequency separation, utilizing the method of moving averages, whereby the pitch angle of the vehicle body 2 is obtained.

2. Then, acceleration components are derived by frequency separation, specifically, by subtracting the above low frequency components from the pitch angle data sequentially read, whereby the acceleration of the vehicle body 2 is obtained.

Step 7 to Step 12: When the speed range selected in the transmission 34 is the first forward speed (F1) or the second forward speed (F2), an actual tractive force $F_R$ is calculated in either of the following methods selected depending on whether the torque converter 33 is in the state of "locked-up" or "torque converting".

1. "Locked-up"

Figure 6:
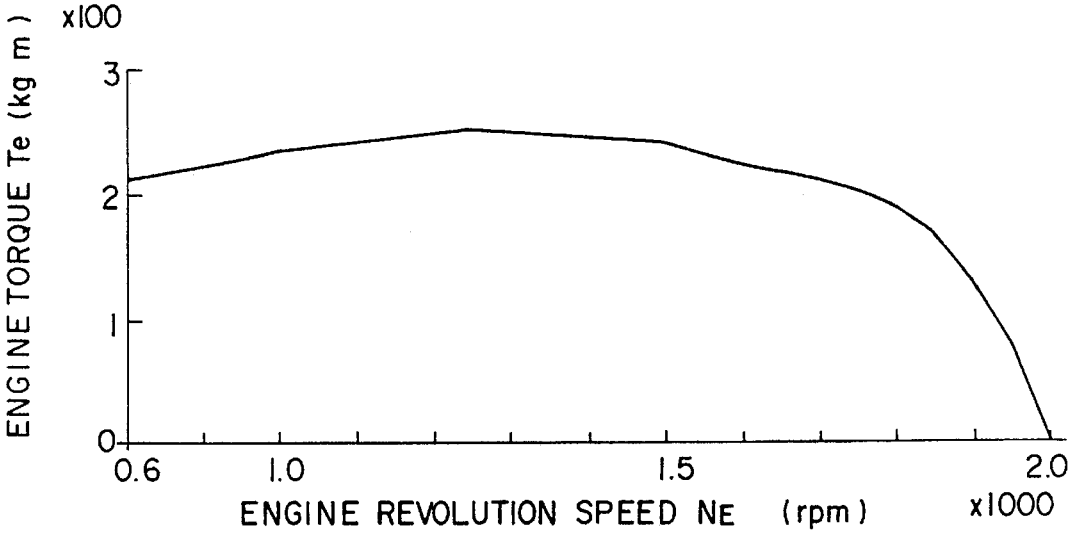
Figure 7:
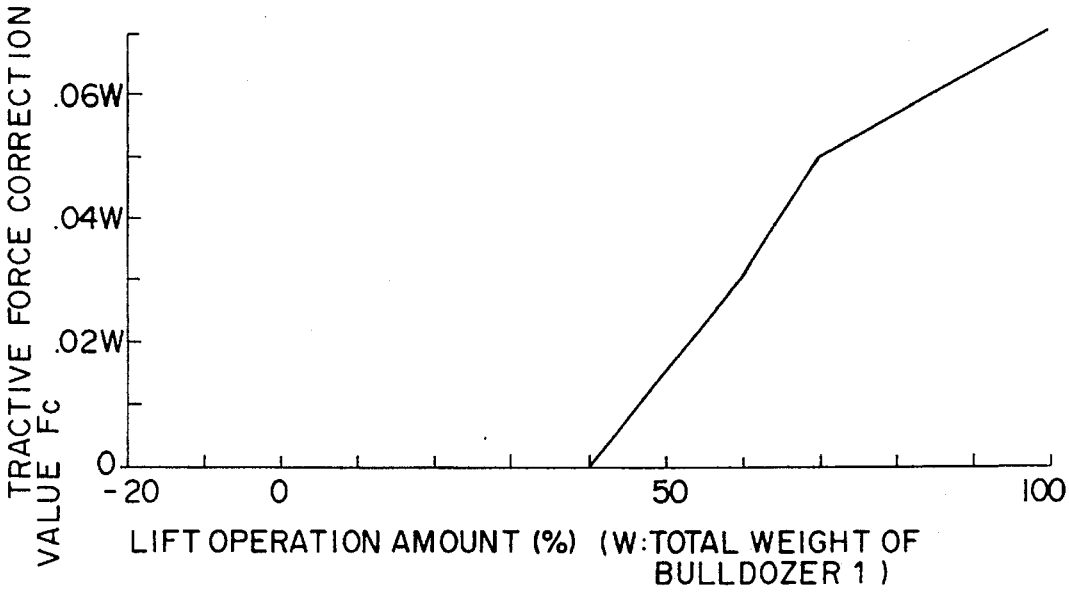

Engine torque Te is obtained from the curved engine characteristic map as shown in FIG. 6, using the revolution speed Ne of the engine 30. Then, the engine torque Te is multiplied by a reduction ratio $k_{se}$ provided over the range of the transmission 34, the steering mechanism 35 and the final reduction mechanisms 36 (in other words, the reduction ratio between the output shaft of the torque convertor 33 and the sprockets 6) and further multiplied by the diameter r of the sprocket 6, to thereby obtain a tractive force Fe ($=Te\times k_{se}\times r$). A tractive force correction value Fc is subtracted from the tractive force Fe, thereby obtaining an actual tractive force $F_R$ ($=Fe-Fc$). The tractive force correction value Fc corresponds to the consumption amount of the hydraulic pumps including operation pumps working on the blade lift cylinders 11 and so on in the PTO 32, and can be obtained from the pump correction characteristic map as shown in FIG. 7, using the lift operation amount of the blade 7.

2. "Torque converting"

Figure 8:
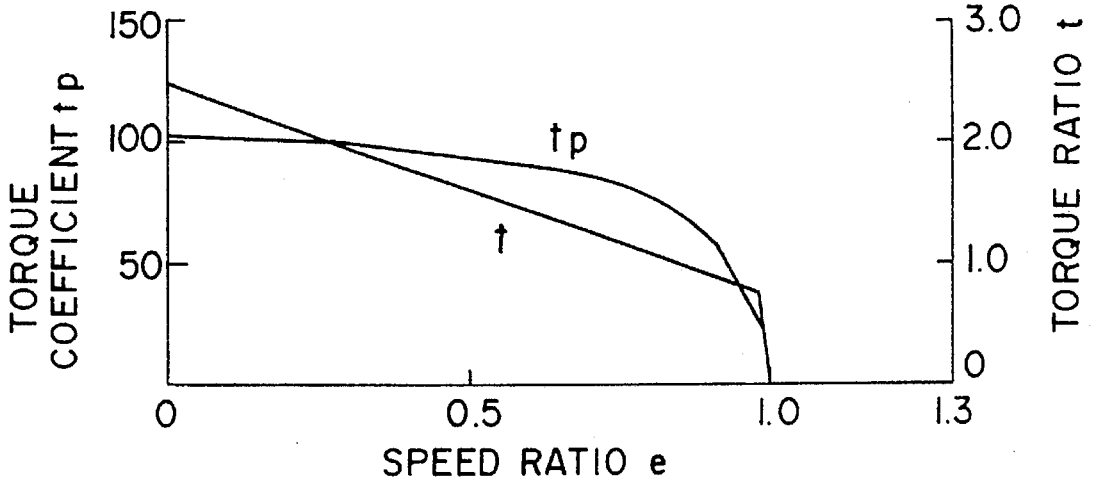

A torque coefficient $t_p$ and torque ratio t are obtained from the curved torque convertor characteristic map as shown in FIG. 8, using the speed ratio e ($=Nt/Ne$) that is the ratio of the revolution speed Ne of the engine 30 to the revolution speed Nt of the output shaft of the torque converter 33, and then torque convertor output torque Tc ($=t_p\times(Ne/1000)^2\times t$) is obtained. Like the case 1, the torque convertor output torque Tc is multiplied by the reduction ratio $k_{se}$ between the output shaft of the torque convertor 33 and the sprockets 6 and further multiplied by the diameter r of the sprocket 6, to thereby obtain an actual tractive force $F_R$ ($=Tc\times k_{se}\times r$).

Figure 9:
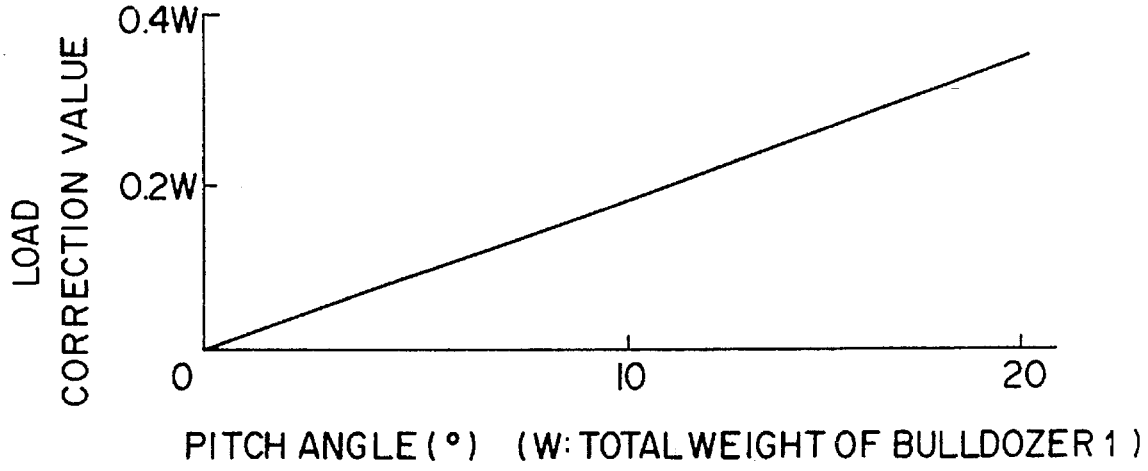

A load correction value, which corresponds to the pitch angle of the vehicle body 2 and can be obtained from the pitch angle-load correction value characteristic map as shown in FIG. 9, is subtracted from the actual tractive force $F_R$ thus obtained, thereby obtaining an actual tractive force after correction F.

Then, the lift tilt relative angle of the blade 7 is calculated from the pivotal angles of the right and left blade lift cylinders 11 measured by the potentiometers 54 of the blade lift cylinder stroke sensors 41.

Step 13 to Step 14: If the automatic blade control mode is selected in dozing operation, a target tractive force is set as follows, according to the number of times the driving mode selector button 22 is pressed. Specifically, when the selector button 22 is pressed once, the automatic digging mode is selected and when the selector button 22 is pressed twice, the automatic carrying mode is selected. It is noted that the manual operation mode is selected when the selector button 22 is not pressed or pressed three times.

1. Where the automatic digging mode is selected:

Comparison is made between (i) an initial actual tractive force after correction F', which is the initial value of the actual tractive force after correction obtained at the time when the driving mode is switched to the automatic digging mode, (ii) the dial value set by the first dial switch 19A for determining the magnitude of a load on the blade 7, and (iii) a lower limit value. In the meantime, in order to gradually bring the actual tractive force close to the target tractive force $F_0$ which corresponds to the dial value, a temporary target tractive force $F_0$ is sequentially obtained from the following calculation, based on the cumulative value X of unit tractive force components ΔW which are accumulated during repetitive executions of the program. Note that the time required for the repetition of the program is 20 m seconds in this embodiment.

(i) If the initial actual tractive force after correction F' exceeds the dial value:

Temporary target tractive force $F_0$←Initial actual tractive force after correction F'—Cumulative value X (ii) If the initial actual tractive force after correction F' is intermediate between the dial value and the lower limit value:

Temporary target tractive force $F_0$←Initial actual tractive force after correction F'+Cumulative value X (iii) If the initial actual tractive force after correction F' is below the lower limit value:

Temporary target tractive force $F_0$←Lower limit value+Cumulative value X

The temporary target tractive force $F_0$ is repeatedly obtained by the above calculation until the temporary target tractive force $F_0$ becomes equal to a tractive force corresponding to the dial value set for determining the magnitude of a load on the blade 7, and at the time the temporary target tractive force $F_0$ becomes equal to the tractive force corresponding to the dial value, this tractive force is set as a target tractive force F.

The reason for setting the lower limit value is that if the calculation for obtaining the temporary target tractive force $F_0$ is started when the actual tractive force is too small with the cutting edge of the blade 7 scarcely touching the ground, lifting and lowering of the blade 7 cannot be stably controlled.

2. Where the automatic carrying mode is selected:

A specified value α (0.1 to 0.2 W in this embodiment (W: the total weight of the bulldozer 1)) is subtracted from the dial value set by the first dial switch 19A for determining the magnitude of a load on the blade 7, and the value thus obtained is set as a target tractive force $F_0$.

Step 15 to Step 16: The tractive force difference ΔF between the target tractive force and the actual tractive force after correction is obtained while the display unit 21 indicates a driving mode presently set in dozing operation, i.e., the manual operation mode, automatic digging mode or automatic carrying mode.

Step 17 to Step 21, FIG. 5B: A sensor or similar device (not shown) detects whether the zone presently controlled by the bulldozer is within the normal blade position control zone for the automatic blade control mode. If the zone presently controlled by the bulldozer is not within the normal blade position control zone for the automatic blade control mode, in other words, if the zone presently controlled is not within the load control zone in which the load applied to the blade 7 is controlled to be constant, it is understood that the transmission is placed in forward range and the blade 7 is not at the digging starting position. Therefore, either of the following processes will be taken, depending on whether the lower end of the blade 7 reaches the ground line and on whether the lower end of the blade 7 is horizontal in relation to the vehicle body.

1. The blade lift cylinder stroke sensors 41 detect the position of the blade 7. If they detect that the lower end of the blade 7 does not reach the ground line, a lift operation amount $Q_D$ used for lowering the lower end of the blade 7 to the ground line is obtained and a command for lowering is released to the blade lift cylinders 11.

2. The difference between detected values of the right and left blade lift cylinder stroke sensors 41 is detected. If the lower end of the blade 7 is not horizontal in relation to the vehicle body, a tilt operation amount $Q_T$ used for making the lower end of the blade 7 horizontal relative to the vehicle body is obtained and a command for tilting is released to the blade tilt cylinder 13.

The blade 7 is accordingly lowered to the ground line and then tilted such that its lower end becomes horizontal in relation to the vehicle body. If one end of the blade 7 has already reached the ground line, only the other end is tilted. With this operation, the blade 7 can be lowered to the ground line with its lower end horizontal and can be set in a predetermined reference position for the start of digging.

Step 22 to Step 24: If the zone presently controlled by the bulldozer is within the normal blade position control (load control) zone for the automatic blade control mode, the following process will be taken.

The shoe slip (i.e., running slip) of the vehicle body 2 is detected as "running slip", based on the following conditions, from moving average acceleration 7 and the actual tractive force after correction F. The moving average acceleration $\gamma$ is obtained by applying the method of moving averages to the acceleration of the vehicle body 2 which has been obtained from the acceleration components derived from the pitch angle data by frequency separation.

1. If either of the following conditions is satisfied, the occurrence of running slip is admitted.

$$(1°\div 0.0174G)$$

(1) the moving average acceleration $\gamma < -4°$ or (2) the moving average acceleration $\gamma < -2°$ and the actual tractive force after correction $F > 0.6$ W 2. If either of the following conditions is satisfied, it is admitted that running slip has stopped after occurrence.

(1) the moving average acceleration $\gamma > 0.1°$ or (2) the actual tractive force after correction F> the actual tractive force after correction at the start of running slip F–0.1 W After judging whether or not running slip has occurred based on the foregoing conditions, either of the following steps will be taken in accordance with the judgment.

1. If it is judged that running slip has occurred, a lift operation amount $Q_S$ for lifting the blade 7 is obtained from a slip control characteristic map (not shown) in order to eliminate the running slip by reducing the load applied to the blade 7.

Figure 10:
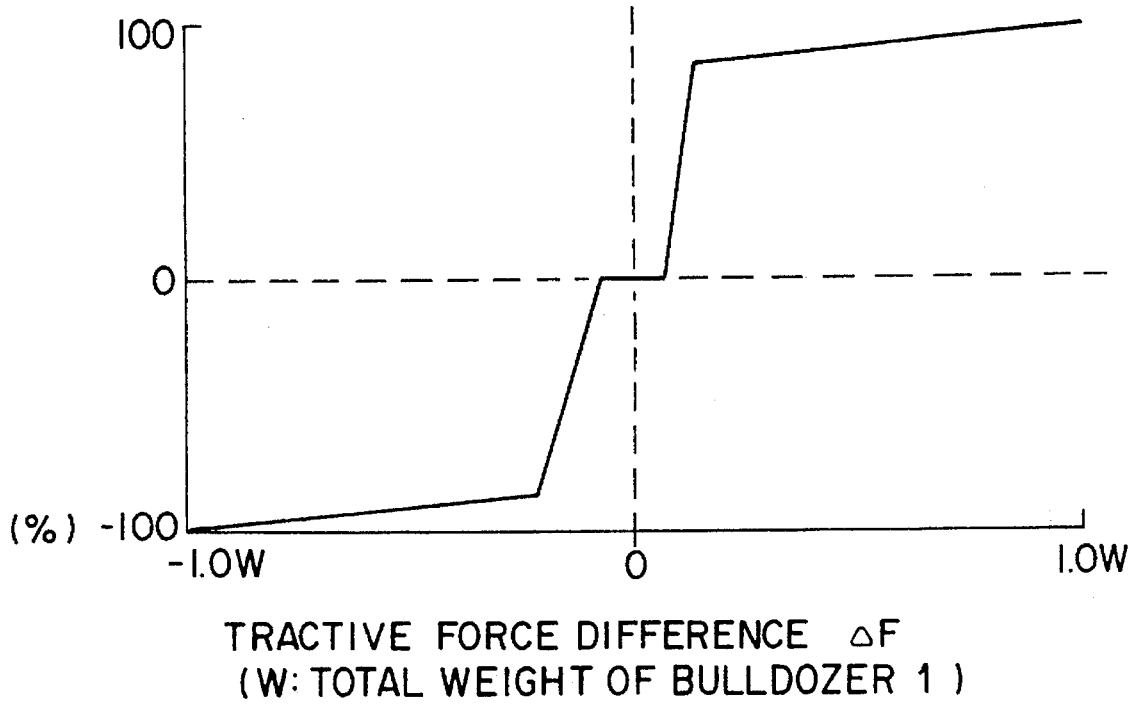

2. If it is judged that no running slip has been detected, a lift operation amount $Q_L$ for lifting or lowering the blade 7 such that the actual tractive force after correction F becomes equal to the target tractive force $F_0$ is obtained from the load control characteristic map shown in FIG. 10, using the tractive force difference $\Delta F$ between the target tractive force $F_0$ and the actual tractive force after correction F.

Step 25 to Step 28: When the transmission has been shifted into reverse range (R), if the blade is not at a position of a predetermined height (the lowest position above the ground) where the blade is positioned when the bulldozer 1 is moving backwards a lift operation amount $Q_H$, used for lifting or lowering the blade 7 to the predetermined position, is obtained and a command for lifting or lowering the blade 7 is released to the blade lift cylinders 11. At the time the blade 7 has reached the predetermined backward moving position, after being lifted or lowered through the above process, the automatic blade control mode is switched to the manual operation mode.

When the voltage of the power source is not normal, being less than the specified value, and the electronic circuit and other devices function abnormally; when the transmission 34 is in other gear conditions than the first forward speed (F1) and the second forward speed (F2); or when the manual operation mode is selected, a lift operation amount $Q_N$ for lifting or lowering the blade 7 is obtained from a manual control characteristic map (not shown), according to the operation amount of the blade control lever 18 in Step 29.

The data on the above-mentioned lift operation amounts $Q_D$, $Q_S$, $Q_L$, $Q_H$ and $Q_N$, FIGS. 5A and 5B are supplied to the blade lift cylinder controller 46 which actuates the blade lift cylinders 11 through the lift valve actuator 47 and the lift cylinder operation valve 48 in accordance with the lift operation amounts $Q_D$, $Q_S$, $Q_L$, $Q_H$ and $Q_N$, thereby performing the desired control of lifting or lowering the blade 7. The tilt operation amount $Q_T$ is supplied to the blade tilt cylinder controller 49 which actuates the blade tilt cylinder 13 through the tilt valve actuator 50 and the tilt cylinder operation valve 51, so that the desired control of tilting the blade 7 can be performed.

Figure 11:
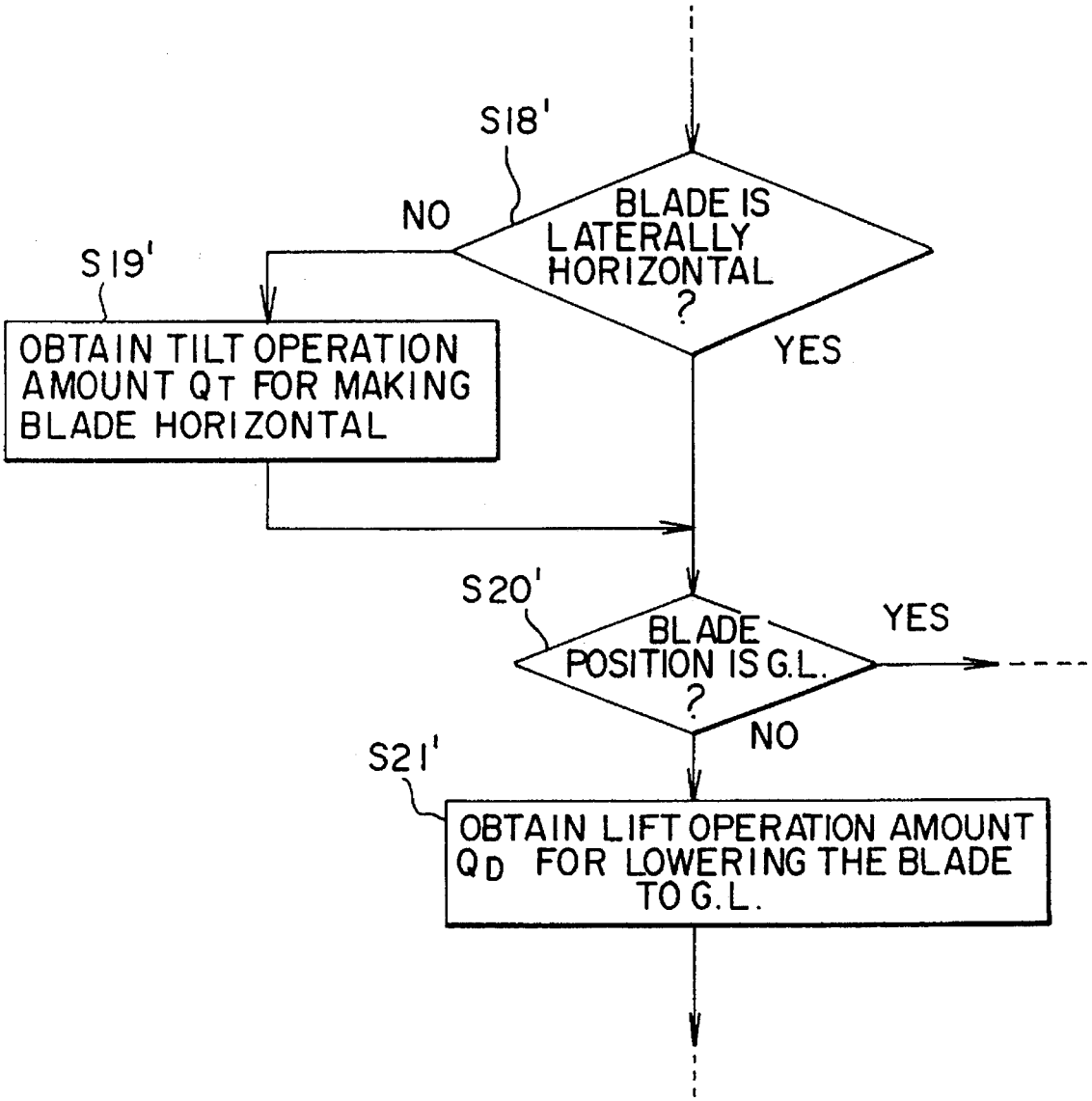

In Steps 18 to 21 of the flow chart of the foregoing embodiment, FIG. 5B, the blade 7 is tilted such that its lower end becomes horizontal in relation to the vehicle body after the blade 7 has been lowered to the ground line. However, it is readily apparent that the blade 7 can be lowered to the ground line after the blade 7 has been tilted such that its lower end becomes horizontal relative to the vehicle body. In this case, Steps 18 to 21 are replaced by Steps 18' to 21' as shown in FIG. 11. It is also possible to tilt the blade 7 while the blade 7 is being lowered.

In the foregoing embodiment, when the transmission has been shifted into reverse range, the blade 7 is lifted or lowered so as to be closer to a position of a specified height, but arrangement may be made such that when the transmission has been shifted into reverse range, the blade 7 is once lifted to a position having the same height as that of the bonnet 3 and then lowered to the predetermined backward moving position.

In the foregoing embodiment, it is, judged based on a signal from the transmission speed range sensor 43, whether the transmission 34 is in forward range or reverse range, but it is also possible that a switch for identifying the operational position of the transmission shift lever 16 is provided and the speed range of the transmission 34 is detected by means of this switch.

Although the actual tractive force is obtained by calculation when it is detected in the embodiment, the actual tractive force could be obtained from the amount of driving torque, detected by a driving torque sensor, for detecting the driving torque of the sprockets 6. Another alternative is that the actual tractive force is obtained, based on the magnitude of bending stress detected, by a bending stress sensor for detecting bending stress that is exerted on the trunnions 10 by the straight frames 8 for supporting the blade 7.

In the foregoing embodiment, the invention has been particularly described with the power transmission system equipped with the torque convertor 33 having a lock-up mechanism, but the invention is not necessarily limited to this as it may be applied to cases where a torque convertor having no lock-up mechanism or a direct transmission having no torque convertor is employed. When such a direct transmission is employed, the actual tractive force is calculated in the same way as described in the case of "locked-up" in the foregoing embodiment.

Further, in the embodiment, the running slip of the vehicle body 2 is detected by deriving acceleration components by frequency separation from the pitch angle data output from the pitch angle sensor 42, but it may be detected from an output from an independent acceleration sensor, the output indicating the accelerated condition of the vehicle body 2. Alternatively, a Doppler speed meter may be employed and the running slip is detected by comparing the actual speed of the vehicle body 2, measured by the Doppler speed meter, with the traveling speed of the crawler belts 5 used for running the vehicle body 2.

For switching the driving modes, the foregoing embodiment employs the driving mode selector button 22 operated by depressing. This selector button 22 could be replaced by a grip-type selector switch, a twisting-type selector switch or a rotary selector switch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A blade control system for use in a bulldozer having a body, comprising:

(a) driving mode setting means for setting an automatic blade control mode during dozing operation;

(b) running condition detector means for detecting whether a transmission is placed in forward range or reverse range; and (c) blade controller means for: (i) controlling tilting and lowering of a blade such that when the running condition detector means has detected that the transmission is placed in forward range and the driving mode setting means has set the automatic blade control mode to start digging, a lower end of the blade is adjusted to a position horizontal in relation to said body and said blade is brought into contact with the ground, and (ii) controlling tilting and lowering of a blade such that when the running condition detector means has detected that the transmission is placed in reverse range and the driving mode setting means has set the automatic blade control mode, the lower end of the blade takes its backward moving position which is at least at a specified distance above the ground.

2. The blade control system for use in a bulldozer as set forth in claim 1, further comprising blade lifting/lowering means for lifting and lowering the blade.

3. The blade control system for use in a bulldozer as set forth in claim 2, wherein the blade lifting/lowering means has a pair of hydraulic cylinders one of which is disposed between a right end of the blade and the vehicle body and the other of which is disposed between a left end of the blade and the vehicle body.

4. The blade control system for use in a bulldozer as set forth in claim 3, further comprising blade position detector means for detecting the lifted/lowered position and tilted position of the blade.

5. The blade control system for use in a bulldozer as set forth in claim 4, wherein the blade position detector means detects the lifted/lowered position and tilted position of the blade by detecting the strokes of the pair of hydraulic cylinders provided in the blade lifting/lowering means.

6. The blade control system for use in a bulldozer as set forth in claim 1, wherein said blade tilting and lowering means tilts the blade in relation to the vehicle body by lifting or lowering an end of the blade.

7. The blade control system for use in a bulldozer as set forth in claim 6, wherein the blade tilting and lowering means comprises a hydraulic cylinder disposed between one end of the blade and the vehicle body and a brace disposed at the other end of the blade and the vehicle body.

8. The blade control system for use in a bulldozer as set forth in claim 1, wherein the blade controller means controls the blade such that the blade is lowered after being tilted.

9. The blade control system for use in a bulldozer as set forth in claim 1, wherein the blade controller means controls the blade such that the blade is tilted after being lowered.

10. A blade control system for use in a bulldozer having a body, comprising:

(a) driving mode setting means for setting an automatic blade control mode during dozing operation;

(b) running condition detector means for detecting whether a transmission is placed in a forward range or a reverse range; and (c) blade controller means for controlling tilting and lowering of a blade such that when the running condition detector means has detected that the transmission is placed in reverse range and the driving mode setting means has set the automatic blade control mode, the lower end of the blade takes its backward moving position which is at a specified distance above the ground.

11. The blade control system for use in a bulldozer as set forth in claim 10, further comprising a blade lifting/lowering means for lifting and lowering the blade.

12. The blade control system for use in a bulldozer as set forth in claim 11, wherein the blade lifting/lowering means has a pair of hydraulic cylinders one of which is disposed between a right end of the blade and the vehicle body and the other of which is between a left end of the blade and vehicle body.

13. The blade control system for use in a bulldozer as set forth in claim 12, further comprising a blade position detector means for detecting the lifted/lowered position of the blade.

14. The blade control system for use in a bulldozer as set forth in claim 13, wherein the blade position detector means detects the lifted/lowered position of the blade by detecting the strokes of the pair of hydraulic cylinders provided in the blade lifting/lowering means.

15. The blade control system for use in a bulldozer as set forth in claim 10, further comprising driving mode switching means for switching from the automatic blade control mode to a manual operation mode after the blade has been lifted or lowered to the backward moving position by the blade controller means.

16. The blade control system for use in a bulldozer as set forth in claim 10, wherein there are provided, as the automatic blade control mode, at least an automatic digging mode associated with digging in dozing operation and an automatic carrying mode associated with carrying in dozing operation.

17. The blade control system for use in a bulldozer as set forth in claim 10, wherein the driving mode setting means is a push button selector switch, a grip-type selector switch, a twisting-type selector switch or a rotary selector switch.

18. The blade control system for use in a bulldozer as set forth in claim 1, wherein there are provided, as the automatic blade control mode, at least an automatic digging mode associated with digging in dozing operation and an automatic carrying mode associated with carrying in dozing operation.

19. The blade control system for use in a bulldozer as set forth in claim 1, wherein the driving mode setting means is a push button selector switch, a grip-type selector switch, a twisting-type selector switch or a rotary selector switch.

* * * * *